United States Patent [19]

Ichikawa

[11] 4,368,355

[45] Jan. 11, 1983

[54] AM STEREOPHONIC SIGNAL RECEIVER WITH ELECTRIC FIELD STRENGTH DETECTION

[75] Inventor: Toshihito Ichikawa, Kawagoe, Japan

[73] Assignee: Pioneer Electronic Corporation, Tokyo, Japan

[21] Appl. No.: 227,119

[22] Filed: Jan. 21, 1981

[30] Foreign Application Priority Data

Jan. 28, 1980 [JP] Japan ..... 55-8646

[51] Int. Cl.[3] ..... H04H 5/00

[52] U.S. Cl. ..... 179/1 GS; 179/1 GM

[58] Field of Search ..... 179/1 D, 1 GD, 1 GE, 179/1 GM, 1 GN, 1 GS; 455/339, 340

[56] References Cited

U.S. PATENT DOCUMENTS

| | | | |
|---|---|---|---|
| 4,157,455 | 6/1979 | Okatani et al. | 179/1 GM |
| 4,206,317 | 6/1980 | Kahn | 179/1 GS |
| 4,208,547 | 6/1980 | Simeau | 179/1 GD |

*Primary Examiner*—A. D. Pellinen

*Attorney, Agent, or Firm*—Sughrue, Mion, Zinn, Macpeak & Seas

[57] ABSTRACT

An AM stereophonic receiver in which degradation of the quality of reproduced sound due to a decreased electric field strength is prevented. A main signal detector produces a sum signal representing the sum of first and second channel signals while a sub signal detector produces a difference signal representing the difference therebetween. The sum signal is coupled directly to a matrix circuit while the difference signal is coupled through a variable control type low-pass filter and a monophonic/stereophonic switch to the matrix circuit. The low-pass filter is controlled by a detection signal representative of the electric field strength of the received signal to reduce high frequency components when the electric field strength decreases below a predetermined value. The low-pass filter is bypassed when the electric field strength is sufficiently high.

7 Claims, 2 Drawing Figures

AM STEREOPHONIC SIGNAL RECEIVER WITH ELECTRIC FIELD STRENGTH DETECTION

BACKGROUND OF THE INVENTION

The present invention relates to AM stereophonic signal receivers and more particularly to an AM stereophonic signal receiver which is suitable for receiving signals using either an AM-FM stereophonic technique or an AM-PM stereophonic technique.

In an AM stereophonic broadcast system, it is necessary that the carrier wave be amplitude-modulated with the sum (main) signal of the right and left channel signals so as to be compatible for reception by a monophonic signal receiver. The difference (sub) signal between the right and left channel signal is transmitted for stereophonic signal reproduction. Any of an AM/AM technique, an AM/FM technique or an AM/PM technique can be used as the AM stereophonic broadcast technique.

In accordance with the AM/AM technique, transmission is carried out by amplitude modulating with the sub signal a carrier wave which is equal in frequency to and different by 90° in phase from the carrier wave of the main signal. The AM/AM technique is called "an orthogonal modulation technique". In accordance with the AM/FM and AM/PM techniques, a carrier wave is phase angle-modulated (FM or PM) with the sub signal and the modulated carrier wave is amplitude modulated with the main signal prior to transmission.

Especially with the AM/PM and AM/FM techniques, because of the bandwidth limitations of the AM broadcast band, the frequency and phase deviations of the sub signal are limited. This leads to an inherent reduction in the electric field strength of a signal reaching a receiver so that the quality of the reproduced signal at the sub detection output is degraded more than that at the main detection output as a result of which the quality of sound obtained by reproducing the right and left channel signals is highly degraded.

Accordingly, an object of the invention is to provide an AM stereophonic signal receiver in which degradation of the quality of sound due to a decreased electric field strength with the AM/PM and AM/FM techniques is prevented thereby to provide satisfactory reproduction outputs.

SUMMARY OF THE INVENTION

This and other objects of the invention are met by a circuit in which, when the received electric field strength is smaller than a predetermined value, a detection signal is provided to activate a low-pass filter thereby to cut off the high frequency components of the sub signal. When the electric field strength falls below the predetermined value, a control signal corresponding to the received electric field strength is produced to vary the cut-off characteristic of the low-pass filter.

In accordance with the invention, a control signal whose level is changed continuously according to the electric field strength is produced and the time constant of the filter is changed in response to the level of the control signal to control the treble cut-off characteristic of the low-pass filter. Alternately, the high frequency cut-off characteristic of the low-pass filter may be controlled by a control signal whose level is stepwise changed according to the electric field strength to therefore control the characteristic of the filter in corresponding steps.

With this arrangement, the high frequency components of the sub signal are cut off according to the electric field strength and the separation of the right and left channel signals is lessened gradually in the high frequency ranges as a result of which the quality of sound is maintained satisfactory in the stereophonic mode. In the case when the electric field strength is sufficiently large, the low-pass filter is bypassed so that the sub signal is applied directly to a matrix circuit whereby the normal signal receiving condition is provided.

DESCRIPTION OF THE PREFERRED EMBODIMENTS

The invention will be described with reference to the accompanying drawings.

Figure 1:
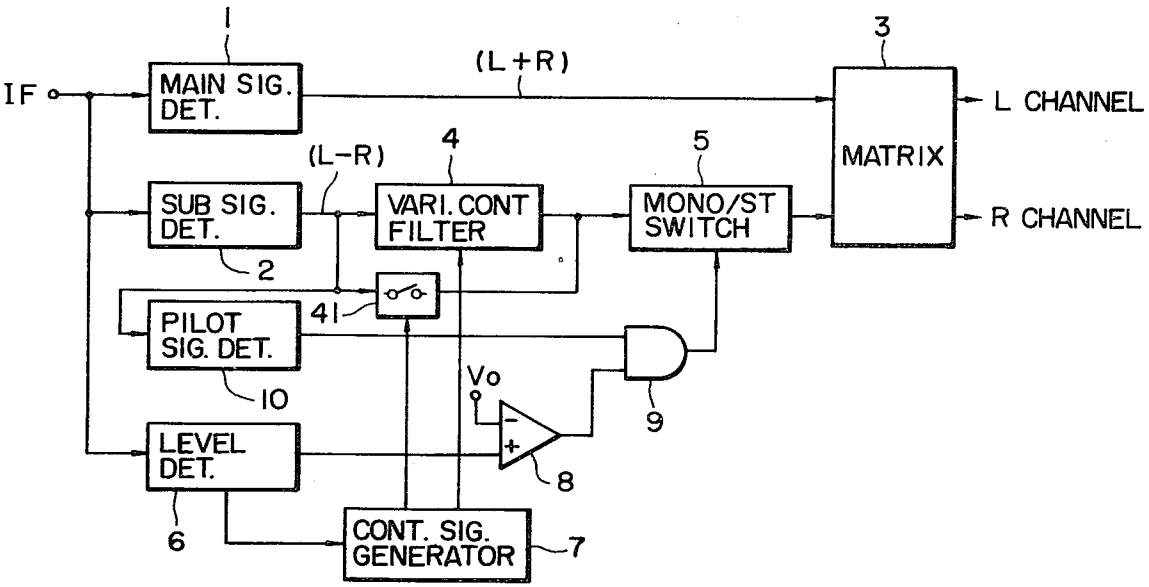
FIG. 1 is a block diagram showing a preferred embodiment of a receiver circuit of the invention.

FIG. 1 is a block diagram showing a preferred embodiment of a circuit of the invention. An IF signal is applied to a main signal detector 1 and a sub signal detector 2 in response to which the detectors 1 and 2 output a main signal and a sub signal, respectively. The main signal is applied directly to a matrix circuit 3. The sub signal is applied to the matrix circuit 3 through a variable control type LPF (low-pass filter) 4, the treble cut-off characteristic of which is variable, and through a monophonic-stereophonic change-over switch 5. In the matrix circuit, the main and sub signals are suitably subjected to a matrix operation to be separated into right and left channel signals, i.e. demodulated stereophonically.

An IF signal level detector 6 is provided to detect the received electric field strength. In response to the output level of the IF signal level detector 6, a control signal generator 7 outputs a control signal to control the treble cut-off characteristic of the LPF 4. A switch 41 is provided in order to bypass the LPF 4. More specifically, when the electric field strength is sufficiently large and accordingly the quality of sound is satisfactory, the control signal generator 7 outputs a detection signal to turn on the switch 41 to bypass the LPF 4.

The output of the IF level detector 6 is compared with a reference level $V_0$ by a comparator 8. The comparison output of the comparator 8 is applied one input terminal of an AND gate 9 to the other input terminal of which the detection output of a pilot detector circuit 10 which operates to detect the pilot signal which is included in the detection output of the sub signal detector 2. Accordingly, if the electric field strength is greatly decreased to reduce the S/N ratio during reception of a stereophonic broadcast when a pilot signal is present, the output of the comparator 8 is set to a low logical level "L" and therefore the output of the AND gate 9 is also set to "L". As a result, the switch 5 is switched to "monophonic" so that the receiver is forcibly operated in a monophonic mode to prevent reduction of the S/N ratio of the output signal.

Figure 2:
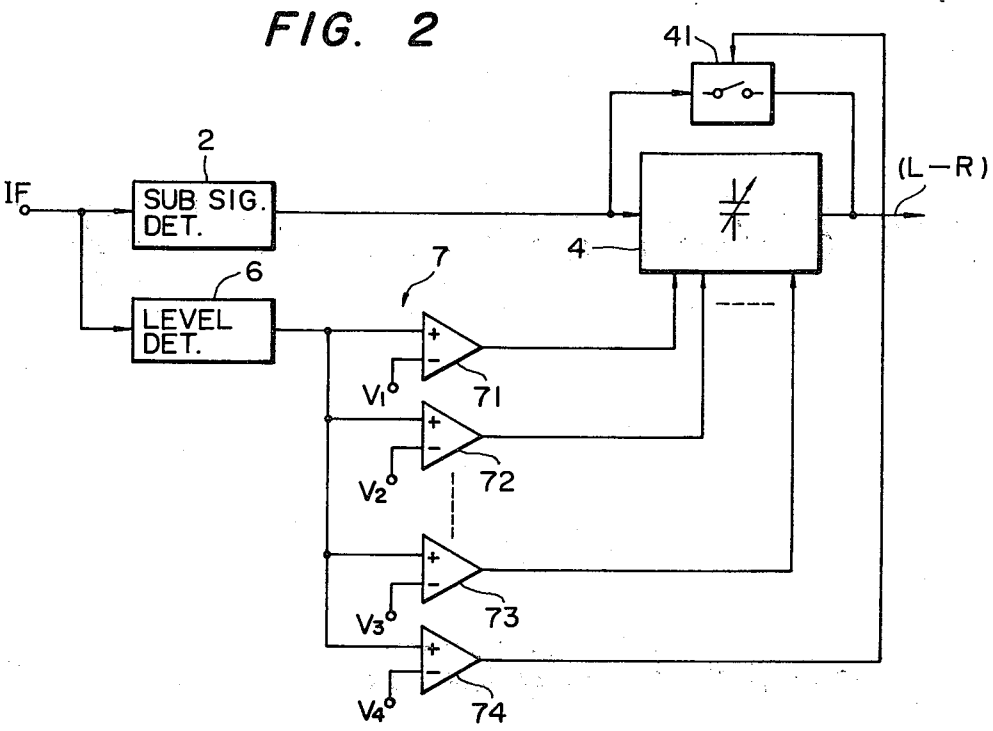
FIG. 2 is a block diagram showing details of a part of the circuit in FIG. 1.

FIG. 2 is a diagram showing examples of the control signal generator 7 and the variable control type LPF 4. The output level of the level detector 6 is applied to a plurality of comparators 71, 72, 73 and 74 where it is compared with reference levels $V_1$, $V_2$, $V_3$ and $V_4$, respectively. The reference levels are so selected as to be $V_0<V_1<V_2<V_3<V_4$. The output of the comparators 71, 72 and 73 are utilized to variably control the capacitance of a capacitor in the LPF 4 and the output of the comparator 74 is used to control the switch 41 for bypassing the LPF.

Accordingly, when the electric field strength is sufficiently large (larger than $V_4$), the outputs of all the comparators are raised to high logical levels. As a result, a switch 41 is turned on and the sub detection output is applied directly, by-passing the LPF 4, to the matrix circuit. Thus, ordinary demodulation is then carried out.

If the electric field strength drops sufficiently to degrade the quality of the sub signal, the outputs of the comparators 71, 72 and 73 are changed as a result of which the capacitance in the LPF 4 is stepwise controlled so as to gradually increase the amount of treble cut-off of the sub signal. Accordingly, the separation in the high frequency range is stepwise lessened to prevent degradation of reproduced sound quality in the stereophonic mode. When the electric field strength falls to $V_0$ or less, then the switch 5 is switched to "monophonic" to prevent a further decrease of the S/N ratio.

As is apparent from the above description, according to the invention, degradation of the quality of reproduced sound due to a decrease of the received electric field strength is prevented. Therefore, degradation of sound quality in the stereophonic mode, such as may be due to fading, is minimized.

In the above-described circuit, the IF signal level is detected in order to detect the received electric field strength. However, the same effect can be obtained by detecting the level of the sub signal or the pilot signal since these levels are also in proportion to the received electric field strength.

What is claimed is:

1. An AM stereophonic signal receiver comprising: detecting means operating in response to a received AM stereophonic signal for producing a sum signal representative of the sum of first and second channel signals and a difference signal representative of the difference between said first and second channel signals;

electric field strength detecting means for producing a detection signal when an electric field strength of said received AM stereophonic signal is smaller than a first predetermined value;

a low-pass filter having an input coupled to receive said difference signal, said low-pass filter operating in response to said detection signal to reduce high frequency components in said difference signal; and matrix circuit means operating in response to said sum signal and an output of said low-pass filter for producing said first and second channel signals.

2. The AM stereophonic signal receiver as claimed in claim 1 wherein said electric field strength detecting means comprises control signal generating means for generating a control signal corresponding to said electric field strength of said received AM stereophonic signal, and said low-pass filter comprises a variable control type low-pass filter having a treble cut-off characteristic controlled according to said control signal.

3. The AM stereophonic signal receiver as claimed in claim 2 wherein said control signal generating means comprises a plurality of comparators, each of said comparators having a first input coupled to a reference voltage source with the voltage applied to said first inputs being different for each of said comparators and said comparators having a second input coupled in common and wherein said control signal generating means further comprises a level detector having an input coupled to said received AM stereophonic signal and an output coupled to said second inputs of said comparators.

4. The AM stereophonic signal receiver as claimed in claim 1 further comprising switch means bypassing said low-pass filter, said switching means operating in response to an output of said electric field strength detecting means for bypassing said low-pass filter when said electric field strength is greater than a second predetermined value.

5. The AM stereophonic signal receiver as claimed in claim 4 further comprising second switch means coupled between said output of said low-pass filter and said matrix circuit means and means for setting said second switch means in an ON state when a pilot signal is received and in an OFF state when no pilot signal is received.

6. The AM stereophonic signal receiver as claimed in claim 4 further comprising second switch means coupled between said output of said low-pass filter and said matrix circuit means, pilot signal detecting means operating in response to said different signal for producing a signal indicative of the presence of a stereophonic pilot signal; a comparator having a first input coupled to a fixed voltage source and a second input coupled to an output of said electric field strength detecting means; and an AND gate having a first input coupled to said signal indicative of the presence of a stereophonic pilot signal, a second input coupled to an output of said comparator and an output coupled to a control input of said second switch means wherein said second switch means is in an ON state for received stereophonic signals and in an OFF state for monophonic signals.

7. An AM stereophonic signal receiver comprising:

a main signal detector for producing a sum signal representative of the sum of first and second channel signals;

a sub signal detector for producing a difference signal representative of the difference between said first and second channel signals, said main signal detector and said sub signal detector having inputs coupled to a IF output of said receiver;

a variable control type low-pass filter having an input coupled to said difference signal;

matrix circuit means for producing first and second channel signals, said sum signal being coupled to a first input of said matrix circuit means;

monophonic/stereophonic switch means coupled between an output of said low-pass filter and a second input of said matrix circuit means;

bypass switch means coupled to bypass said low-pass filter;

level detecting circuit means having an input coupled to said IF signal for producing a signal corresponding to the electric field strength of a received signal;

a plurality of first comparators, said comparators each having a first input coupled to said signal corresponding to the electric field strength of said received signal at an output of said level detecting means and each of said comparators having a second input coupled to a reference voltage source with the voltage applied to said second inputs of each of said comparators being different, outputs of said comparators being coupled to control inputs of said low-pass filter;

pilot signal detecting means having an input coupled to said difference signal for producing a signal indicative of the presence of a received stereophonic signal;

a second comparator having a first input coupled to an output of said level detecting means and a second input coupled to a reference voltage source; and an AND gate having a first input coupled to said signal indicative of the presence of a stereophonic signal and a second input coupled to an output of said second comparator, an output of said AND gate being coupled to a control input of said monophonic/-stereophonic switch means.

* * * * *